US010327469B2

(12) United States Patent
Papakyrillou et al.

(10) Patent No.: US 10,327,469 B2
(45) Date of Patent: Jun. 25, 2019

(54) SMOKING ARTICLE WITH FLOW RESTRICTOR ADAPTED TO PROMOTE FILTER DEGRADATION

(71) Applicant: PHILIP MORRIS PRODUCTS S.A., Neuchatel (CH)

(72) Inventors: Stefanos Papakyrillou, Cortaillod (CH); Leonardo Nappi, Vallamand (CH)

(73) Assignee: Philip Morris Products S.A., Neuchatel (CH)

( * ) Notice: Subject to any disclaimer, the term of this patent is extended or adjusted under 35 U.S.C. 154(b) by 88 days.

(21) Appl. No.: 15/523,761

(22) PCT Filed: Dec. 1, 2015

(86) PCT No.: PCT/EP2015/078248

§ 371 (c)(1),
(2) Date: May 2, 2017

(87) PCT Pub. No.: WO2016/087463

PCT Pub. Date: Jun. 9, 2016

(65) Prior Publication Data

US 2017/0311643 A1 Nov. 2, 2017

(30) Foreign Application Priority Data

Dec. 3, 2014 (EP) ..... 14196164

(51) Int. Cl.
*A24D 3/14* (2006.01)
*A24D 3/06* (2006.01)
(Continued)

(52) U.S. Cl.
CPC ..... *A24D 3/145* (2013.01); *A24D 3/0216* (2013.01); *A24D 3/048* (2013.01); *A24D 3/068* (2013.01); *A24D 3/10* (2013.01)

(58) Field of Classification Search
None
See application file for complete search history.

(56) References Cited

U.S. PATENT DOCUMENTS 9,155,335 B2 * 10/2015 Robertson ..... A24D 3/068
2011/0174324 A1 7/2011 Robertson
(Continued)

FOREIGN PATENT DOCUMENTS

WO WO 2009/079202 6/2009
WO WO 2011/077141 6/2011
(Continued)

OTHER PUBLICATIONS

International Search Report and Written Opinion for PCT/EP2015/078248 dated Jan. 27, 2016 (10 pages).
(Continued)

*Primary Examiner* — Dennis R Cordray
(74) *Attorney, Agent, or Firm* — Mueting, Raasch & Gebhardt, P.A.

(57) ABSTRACT

A smoking article comprises a tobacco rod and a filter component. The filter component comprises a first filter segment of filtration material having a diameter measured perpendicular to a longitudinal direction of the filter, and a flow restrictor embedded in the filter segment. At least one cross sectional dimension of the flow restrictor, measured in a transverse direction of the filter segment, is at least about 50 percent of the diameter of the filter segment. The flow restrictor is made from an air-impermeable, non-compressible and water-soluble or water-dissolvable material. Further, the flow restrictor comprises a composition that promotes degradation of the filtration material.

13 Claims, 3 Drawing Sheets

(51) Int. Cl.

| | |
|---|---|
| ***A24D 3/02*** | (2006.01) |
| ***A24D 3/10*** | (2006.01) |
| ***A24D 3/04*** | (2006.01) |

(56) References Cited

U.S. PATENT DOCUMENTS

| | | | | |
|---|---|---|---|---|
| 2012/0000481 | A1 | 1/2012 | Potter | |
| 2012/0080044 | A1 | 4/2012 | Yanchev | |
| 2013/0047999 | A1 * | 2/2013 | Rushforth | A24D 3/061 131/332 |

FOREIGN PATENT DOCUMENTS

| | | |
|---|---|---|
| WO | WO 2014/102094 | 7/2014 |
| WO | WO 2014/102096 | 7/2014 |

OTHER PUBLICATIONS

Extended European Search Report for Application No. 14196164.9 dated May 13, 2015 (7 pages).

* cited by examiner

SMOKING ARTICLE WITH FLOW RESTRICTOR ADAPTED TO PROMOTE FILTER DEGRADATION

This application is a U.S. National Stage Application of International Application No. PCT/EP2015/078248, filed Dec. 1, 2015, which was published in English on Jun. 9, 2016, as International Publication No. WO 2016/087463 A1. International Application No. PCT/EP2015/078248 claims priority to European Application No. 14196164.9 filed Dec. 1, 2014.

The present invention relates to a smoking article including a tobacco rod and a filter.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises filtration material circumscribed by a paper plug wrap. Conventionally, the wrapped tobacco rod and the filter are joined by a band of tipping wrapper, normally formed of a paper material that circumscribes the entire length of the filter and an adjacent portion of the wrapped tobacco rod.

Ventilation of mainstream smoke can be achieved with a row or rows of perforations in the tipping paper at a location along the filter. Ventilation dilutes all of the material flowing through the smoking article. For example, in conventional cigarettes ventilation reduces both the particulate phase and the gas phase constituents of the mainstream smoke. However, smoking articles having high levels of ventilation may have levels of resistance-to-draw (RTD) which can be too low to be considered acceptable to a consumer. The inclusion of, for example, one or more high density cellulose acetate filter segments may be used to increase to an acceptable level the overall RTD of smoking articles with high ventilation. However, while known to efficiently reduce particulate phase (for example, tar) deliveries, high-density cellulose acetate filter segments may affect the flavour notes generated by high quality tobacco. On top of that, high-density cellulose acetate filter segments have little or no effect on gas phase (for example, carbon monoxide) deliveries.

It has been proposed to solve this by including a restrictor element in the filter. If used with high ventilation, a restrictor element can increase RTD while both the particulate phase and the gas phase constituents of the mainstream smoke are reduced. Restrictor elements may, for example, be embedded in a plug or tube of filtration material. Further, filter segments including a restrictor element may be combined with other filter segments, for example including other additives, such as sorbents or flavourants.

Cellulose acetate, the most commonly used filtration material, is not biodegradable. Thus, even when restrictor elements made of a biodegradable material are used in combination with a plug of cellulose acetate, a cigarette filter generally degrades very slowly, so disposal of discarded filters may pose an environmental challenge.

A filter is known from WO 2011/077141 that comprises a delivery element containing a liquid capable of enhancing the disintegration or degradation of the smoking article. According to WO 2011/077141, the delivery element can be provided as a capsule, which may be broken to release the liquid immediately prior to disposal of the smoking article, or at a later time following disposal. The delivery element is arranged to be actuated by a longitudinal or bending force acting on the filter, such that, for instance, the action of 'stubbing out' the smoking article acts to release the liquid.

Thus, in practice, in filters according to WO 2011/077141 the mechanism intended to enhance the disintegration of the smoking article can only be activated via the conscious intervention of the user, who is required to implement a predetermined actuation procedure upon disposal of the smoking article or aftwerwards.

It would be desirable to provide a filtered smoking article whereby degradation of the filtration material is made more efficient, while, at the same time, satisfactory values and adjustability of RTD, airflow, CO levels, are ensured. Further, it would be desirable to provide one such filtered smoking article that is comparatively straightforward and inexpensive to manufacture.

According to the present invention, there is provided a smoking article comprising a tobacco rod and a filter component, wherein the filter component comprises a filter segment of filtration material having a diameter measured perpendicular to a longitudinal direction of the filter; and a flow restrictor embedded in the filter segment. At least one cross sectional dimension of the flow restrictor, measured in a transverse direction of the filter segment, is at least about 50 percent of the diameter of the filter segment. The flow restrictor is made from an air-impermeable, non-compressible and water-soluble or water-dissolvable material. Further, the flow restrictor comprises a composition that promotes degradation of the filtration material.

As used herein, the terms "upstream" and "downstream" are used to describe the relative positions of elements, or portions of elements, of the smoking article in relation to the direction in which a consumer draws on the smoking article during use thereof. Smoking articles as described herein comprise a downstream end and an opposed upstream end. In use, a consumer draws on the downstream end of the smoking article. The downstream end, which is also described as the mouth end, is downstream of the upstream end, which may also be described as the distal end.

As used herein, the term "composition that promotes degradation of the filtration material" denotes an agent capable of increasing the degradation rate (by accelerating or favouring degradation) of a material, e.g., a polymer, under predetermined conditions. In the context of the present invention, a "composition that promotes degradation of the filtration material" is used to refer to a degradation-accelerating agent that can promote degradation of the filtration material, for example cellulose acetate. In the context of the present invention, the term "degradation" is intended to include both abiotic and biotic decomposition (biodegradation). Abiotic decomposition involves the degradation of a substance by chemical or physical processes, e.g. hydrolysis or photolysis. Biotic decomposition refers to the metabolic breakdown of a substance into simpler components by living organisms, typically by microorganisms. The "composition that promotes degradation of the filtration material" may be such that its mere presence is sufficient to make the degradation process faster or more efficient. As an alternative, the "composition that promotes degradation of the filtration material" may be such that certain predetermined conditions are required for its activation. By way of example, a "composition that promotes degradation of the filtration material" may be activated by the presence of water, by temperature rising above a threshold value, by exposure to a certain pH, and so forth.

The term "gas permeability" is used throughout this specification to describe the tendency of a given material to allow permeation, that is, the diffusion of molecules of a gas or of a gaseous mixture (the permeant) through the material. Permeation works through diffusion, therefore the permeant will move under a concentration gradient. Permeability is measured in units of area, commonly in squared meters.

As used herein, the terms "air-impermeable" and "gas-impervious" describe a material that does not allow the passage of fluids, particularly air and smoke, through interstices or pores in the material or generally the interior of the material. The flow restrictor of a smoking article according to the present invention is made from a material impermeable to air and smoke, and so air and smoke drawn through the filter are forced to flow around the flow restrictor and through a reduced cross section of filtration material. Thus, the flow restrictor effectively reduces the permeable cross-sectional area of the filter.

The term "non-compressible" is used throughout this specification to mean resistant to compression from any of: manual handling as the smoking article is removed from a pack, digital compression (that is, by a user's fingers on the filter), buccal compression (that is, by a user's lips or teeth on the mouth end of the filter) or the manual extinguishing ("stubbing out") process. In other words, the term "non-compressible" is used to describe a component, such as the flow restrictor of a smoking article according to the present invention, that is not deformable or destructible in the normal handling of a smoking article during manufacture and use.

In the context of the present specification, the expression "compressive yield strength" is used to refer to the value of uniaxial compressive stress reached when there is a permanent deformation of the flow restrictor.

In filtered smoking articles according to the present invention, a flow restrictor is embedded in a segment of filtration material forming part of a filter component of the smoking article. The flow restrictor has a cross-sectional dimension measured perpendicular to the longitudinal axis of the filter that is at least 50 percent of the diameter of the filter. Because the flow restrictor is substantially gas-impervious, it diverts the flow of mainstream smoke drawn into the filter towards the periphery of the filter. In practice, the majority of the flow of mainstream smoke is directed to flow around the flow restrictor and through a passageway having reduced cross-sectional area, compared to the cross-sectional area of the filter. Thus, the flow restrictor generates a RTD that is acceptable for the consumer.

Further, the flow restrictor comprises a composition that promotes degradation of the filtration material, for example by initiating, facilitating or catalyzing hydrolysis, photolysis or biodegradation processes. In particular, the composition can start and maintain the degradation process of the filtration material under certain ambient conditions, such as the presence of water or a humidity above a minimum value. Thus, once the filter of the smoking article is discarded, the filtration material (for example, cellulose acetate but not limited to that specific material) degrades more effectively and quickly compared with filters without the flow restrictor of the invention.

Further, because the flow restrictor is made from a water-soluble or water-dissolvable material, the release of the degradation-accelerating agent is advantageously caused by exposure of the filter to naturally occurring environmental conditions, such as rain and the like, and does not require any action, such as a mechanical action, on the part of the consumer.

It is advantageously easy to manufacture the filter with the flow restrictor according to the invention, since the restrictor may be incorporated directly into the filtration (tow) material. Thus, conventional manufacturing techniques can be used in which the cellulose tow material, with embedded restrictors, is cut into filter segments. In contrast to other known filters, no separate step of inserting the restrictor is required.

Further, because the restrictor comprises a material that promotes degradation of the filtration material, two functions are substantially combined in a single filter component. Thus, the structure of the filter is not complicated and the overall size of the filter can advantageously be contained. In addition, by suitably selecting the size and arrangement of the restrictor within the filter segment, the RTD of the filter and, consequently, of the smoking article can advantageously be adjusted while, at the same time, significantly reducing the environmental impact of the filtration material.

Smoking articles according to the present invention comprise a tobacco rod and a filter component connected to the tobacco rod. The filter component comprises a filter segment of filtration material and a flow restrictor is embedded in the filter segment. The filter segment is circumscribed by a band of plug wrap. The plug wrap may have a basis weight of less than about 90 gsm, preferably less than about 60 gsm, more preferably less than about 40 gsm. The band of plug wrap may be affixed to the filter segment using, for example, an adhesive.

The filtration material may comprise any suitable material or materials. Examples of suitable materials include cellulose acetate, PLA fibres, viscose fibres, crimped paper or combination thereof. In certain embodiments of the invention, due to the compaction of the filter material around the restrictor, a low-density filtration medium might be preferred.

The restrictor is preferably made from a material that is air-impermeable and non-compressible. In general, the restrictor may be provided as a bead, the degradation-accelerating agent being contained or dispersed in the bead.

In some preferred embodiments, the bead may be formed as a polymeric matrix made from a water-soluble material, and the degradation-accelerating agent can be encapsulated and dispersed more or less homogeneously within the polymeric matrix. In alternative embodiments, the restrictor may comprise a hollow bead made from a water-dissolvable material and containing a core comprising the composition promoting degradation of the filtration material.

The water-soluble material is preferably selected from the group consisting of carboxymethyl cellulose (CMC), ethyl cellulose, hydroxypropyl cellulose (HPC), hydroxypropyl methyl cellulose (HPMC), methyl cellulose, polyethylene glycol (PEG), polyvinyl acetate, polyvinyl alcohol, starch, sugar, and combinations thereof. The sugars may be glucose, sucrose, lactose, and combinations thereof.

In other embodiments, the restrictor preferably comprises a bead and the composition promoting degradation of the filtration material at least partially coats the bead. In these embodiments, the coating comprises a water soluble material. Preferably, in these embodiments the coating is entirely formed from a water soluble material.

The bead may be made from various materials. Examples of suitable materials include, but are not limited to, gelatin or other types of hydrocolloids, alginate, carboxymethyl cellulose (CMC), cellulose, starch, polylactic acid, poly (butylene succinate) and its copolymers, poly(butylene adipate-co-terephthalate) and combinations thereof.

Preferably, the composition that promotes degradation of the filtration material comprises at least one of one or more of: nutrients suitable for sustaining microbial growth; one or more compounds adapted to initiate or sustain enzymatic or acidic hydrolysis of the filtration material; one or more acids; one or more acid salts; and one or more bases.

In preferred embodiments, the composition promoting degradation of the filtration material comprises one or more nutrients suitable for consumption by microorganisms. Without wishing to be bound by theory, this is expected to favour the rapid proliferation of microorganisms when a filter is discarded and the nutrients become available for the microorganisms, either by the mere presence of the composition in the filter or upon activation of a release mechanism as has been described above. As a result, the growing microorganisms excrete degradative enzymes (e.g., cellulases), acidic compounds or both which will initiate and sustain degradation (for example, hydrolysis) of cellulose acetate.

Nutrients for microorganisms may include any material that is capable of supporting growth and reproduction of bacteria, fungi, or both that are capable of promoting degradation of the filtration material. The use of nutrients for microorganisms in the composition promoting degradation of the filtration material is advantageous in that it promotes rapid multiplication of the bacteria or fungi so that the degradation rate of the filtration material is significantly increased.

In addition, the composition promoting degradation of the filtration material may preferably further comprise microorganisms selected among:

(a) bacteria producing acid(s) after consuming a nutrient, such as *Lactobacillus acidophilus, Bifidobacterium longum, Acetobacterium woodii, Acetobacter aceti* (vinegar bacteria) or combinations thereof;

(b) bacteria directly attacking cellulose acetate such as *Rhizobium meliloti, Alcaligenes xylosoxidans* or combinations thereof;

(c) bacteria producing cellulase enzymes, such as *Trichoderma viride, Aspergillus niger, Sporotrichum thermophile, Chaetomium cochliodes* or combinations thereof.

In the context of the present application, by "cellulase enzymes" reference is made to any of several enzymes produced by fungi, bacteria, and protozoans that catalyze cellulolysis and the decomposition of some related polysaccharides, namely the hydrolysis of 1,4-beta-D-glycosidic linkages in cellulose, hemicellulose, lichenin, and cereal beta-D-glucans. Without wishing to be bound to theory, cellulases are understood to break down the cellulose molecule into monosaccharides ("simple sugars") such as beta-glucose, or shorter polysaccharides and oligosaccharides. By "cellulases", reference is also made in the context of the present invention to any naturally occurring mixture or complex of various such enzymes, that act serially or synergistically to decompose cellulosic material. Examples include endo-1,4-beta-D-glucanase, carboxymethyl cellulase (CMCase), avicelase, celludextrinase, cellulase A, cellulosin AP, alkali cellulase, cellulase A 3, 9.5 cellulase, and pancellase SS.

In addition, or as an alternative, the composition promoting degradation of the filtration material comprises one or more compounds adapted to initiate or sustain enzymatic or acidic hydrolysis of cellulose acetate. For example, the composition promoting degradation of the filtration material may comprise substances produced by microorganisms, such as degradative enzymes or acidic compounds of microbial origin. Preferred substances produced by microorganisms include cellulase enzymes, acids, and bases.

Preferred acids include acetic, ascorbic, ascorbyl-2-phosphate, ascorbyl-2-sulfate, aspartic (aminosuccinic), cinnamic citric, folic, glutaric, lactic, malic (1-hydroxysuccinic), nicotinic (nician), oxalic, succinic, tartaric, boric, hydrochloric, nitric, phosphoric, sulphuric, and combinations thereof.

Preferred acid salts include metal salts where the metal is selected from aluminium, potassium, sodium or zinc, while the anion is selected from the group consisting of nitrates, dihydrogen phosphates, hydrogen phosphates, phosphates hydrogen sulphates, sulphates and combinations thereof.

Preferred bases include metal hydroxides, calcium oxide (lime), urea, borax, sodium metasilicate, ammonium hydroxide, sodium carbonate, sodium phosphate tribasic, sodium hypochlorite, sodium hydrogen carbonate (sodium bicarbonate) and combinations thereof.

The composition promoting degradation of the filtration material is present in an amount of at least about 0.05 milligrams per milligram of combined weight of the filter segment, preferably at least about 0.10 milligrams per milligram of combined weight of the filter segment, more preferably at least about 0.20 milligrams per milligram of combined weight of the filter segment. The expression "combined weight of the filter segment" is used to describe the overall weight of the segment of filtration material and of any material circumscribing the segment of filtration material in the assembled smoking article, such as any plug wrap or tipping paper or both. Since a low proportion of degradation-accelerating agent is sufficient to achieve a sufficiently high degradation speed, the mechanical properties of the material used for forming the restrictor are advantageously not affected to any significant degree.

Preferably, the restrictor is surrounded on all sides by the filtration material. The expression "surrounded on all sides" is used to mean that the flow restrictor is directly adjacent filtration material in the upstream and downstream (longitudinal) directions, and in the transverse direction, as well (i.e. bead not in separate cavity). Preferably, the restrictor is incorporated into the filtration material during manufacture of the filter material. Thus, porosity within the filter around the restrictor is substantially homogeneous and no preferred, low-pressure-drop paths are made available for the mainstream smoke, which is therefore homogenously diverted around the bead. Thus, substantially all of the available outer surface area of restrictor contacts filtration material, which is advantageous in that it maximises contact of the filtration material with the degradation-accelerating agent, when the latter is activated.

The flow restrictor may be provided as a bead of any suitable shape, including cylindrical, prism-shaped, ovoid, ellipsoid, spheroid, conical, or teardrop-shaped. Preferably, the bead is substantially spherical. The advantage of the spherical shape is above all the ease of manufacture. Further, there is no need to be concerned with the bead orientation in the filtration material. As an alternative, the bead is preferably substantially cylindrical. A cylindrical bead is also easy to manufacture, for example by extrusion, and makes orientation of the flow restrictor in the filter segment relatively easy.

The cross-sectional dimension of the restrictor may preferably be at least 60 percent, more preferably at least 70 percent, even more preferably at least 80 percent of the diameter of the filter segment. In addition, or as an alternative, it is less than about 95 percent, preferably less than about 90 percent. Where the restrictor is provided as a cylindrical bead, the length of the bead is preferably less than about 90 percent of the length of the filter segment.

Preferably, the flow restrictor is formed from a biodegradable polymeric material.

Preferably, the flow restrictor has a compressive stress at yield of at least about 8.0 kPa. The compressive stress at yield may be obtained experimentally by means of standardized test ISO 604. In the test, the specimen (flow restrictor) is compressed by compressive plates along an axis that corresponds to the direction along which a smoker's fingers would exert pressure on the restrictor when the smoker is grasping the smoking article. During the test, the plates are displaced at a constant rate until the load or deformation reaches a predetermined value. The load sustained by the specimen (flow restrictor) is measured during the procedure.

Preferably, the flow restrictor is at least about 6 millimeters from the downstream end of the filter. In addition, or as an alternative, the flow restrictor is at less than about 25 millimeters from the downstream end of the filter.

Preferably, the flow restrictor is able to generate a RTD of at least about 200 millimeters $H_2O$ (about 1960 Pa), preferably at least about 300 millimeters $H_2O$ (about 2940 Pa). Alternatively or in addition, the bead is able to generate a RTD of less than about 500 millimeters $H_2O$ (about 4900 Pa), preferably less than least about 400 millimeters $H_2O$ (about 3920 Pa). The RTD generated by the bead may be assessed as the negative pressure that has to be applied, under test conditions as defined in ISO 3402, to the output end of the filter segment containing the bead, in order to sustain a steady volumetric flow of air of 17.5 milliliters/second through the filter segment, having blocked any ventilation off.

The tobacco rod typically comprises a charge of tobacco circumscribed by a paper wrapper. In more detail, the tobacco rod may comprise any suitable type or types of tobacco material or tobacco substitute, in any suitable form. Preferably, the tobacco rod includes flue-cured tobacco, Burley tobacco, Maryland tobacco, Oriental tobacco, rare tobacco, specialty tobacco, or any combination thereof. Preferably, the tobacco is provided in the form of tobacco lamina, processed tobacco materials, such as volume expanded or puffed tobacco, processed tobacco stems, such as cut-rolled or cut-puffed stems, reconstituted tobacco materials, blends thereof, and the like. In preferred embodiments, the tobacco is in the form of cut filler, that is, in the form of shreds or strands cut into widths ranging from about 2.5 millimeters to about 1.2 millimeters or even about 0.6 millimeters.

The tobacco rod may have a tobacco packing density of at least about 200 milligrams/cubic centimeter. Preferably, the tobacco rod has a tobacco packing density of at least about 220 milligrams/cubic centimeter. More preferably, the tobacco rod has a tobacco packing density of at least about 240 milligrams/cubic centimeter. In addition, or as an alternative, the tobacco rod may have a tobacco packing density of less than about 620 milligrams/cubic centimeter. Preferably, the tobacco rod has a tobacco packing density of less than about 600 milligrams/cubic centimeter. In some preferred embodiments, the tobacco rod has a tobacco packing density from about 400 milligrams/cubic centimeter to about 550 milligrams/cubic centimeter.

To connect the filter component to the tobacco rod, the smoking article may include a band of tipping wrapper circumscribing the filter and at least a portion of the tobacco rod. The tipping wrapper may comprise paper having a basis weight of less than about 70 grams per square meter, preferably less than about 50 grams per square meter. The tipping wrapper preferably has a basis weight of more than about 20 grams per square meter. Thus, the tipping wrapper may provide additional strength and structural rigidity for the filter and reduce the chance of deformation on the outer surface of the filter at the location where the flow restrictor is disposed in the filter component.

Preferably, the tipping wrapper may include a ventilation zone comprising perforations through the tipping wrapper and the underlying plug wrap and allowing ambient air to be drawn into the filter component. Preferably, the ventilation zone comprises at least one circumferential row of perforations provided through the tipping paper and the underlying plug wrap. In some embodiments, the ventilation zone may comprise two circumferential rows of perforations provided through the tipping paper and the underlying plug wrap.

Ventilation, in conjunction with the flow restrictor, advantageously contributes to produce the desired level of RTD. Further, the provision of a filter comprising a flow restrictor according to the invention in combination with a ventilation zone enables the production of highly ventilated smoking articles in which the carbon monoxide to tar ratio of the mainstream smoke is advantageously maintained at an acceptable value.

The tipping wrapper may be a standard pre-perforated tipping wrapper. Alternatively, the tipping wrapper may be perforated (for example, using a laser) during the manufacturing process according to the desired number, size and position of the perforations. Preferably, each circumferential row of perforations comprises from 8 to 30 perforations.

Preferably, the ventilation zone is placed downstream of the flow restrictor such that ventilation air is introduced into the filter segment at a location downstream of the flow restrictor. Preferably, the at least one circumferential row of perforations is at least about 1 millimeter downstream of the centre of the flow restrictor. More preferably, the at least one circumferential row of perforations is at least about 3 millimeters downstream of the centre of the flow restrictor.

Preferably, the ventilation zone is located at least about 2 millimeters upstream from the mouth end of the filter. More preferably, the ventilation zone is located at least about 5 millimeters upstream from the mouth end of the filter. This advantageously makes it less likely for the consumer to obstruct the ventilation zone when holding the smoking article with his or her lips. Preferably, the ventilation zone is located at least about 10 millimeters upstream from the mouth end of the filter.

In addition, or as an alternative, the ventilation zone is preferably located less than about 20 millimeters upstream from the mouth end of the filter. More preferably, the ventilation zone is preferably located less than about 15 millimeters upstream from the mouth end of the filter. In some preferred embodiments, the ventilation zone is preferably located from about 2 millimeters to 20 millimeters upstream from the mouth end of the filter. In some more preferred embodiments, the ventilation zone is preferably located from about 10 millimeters to 15 millimeters upstream from the mouth end of the filter. This provides an appropriate length of hollow tube for ventilation air and mainstream smoke to mix before they reach the mouth end of the smoking article.

The smoking article described above can be assembled using standard manufacturing equipment. The flow restrictor may be manufactured off-line and inserted into the tow material for forming the filter segment. Other parts of the smoking article, such as the tobacco rod, can be manufactured according to standard processes using standard manufacturing equipment.

The invention will be further described, by way of example only, with reference to the accompanying drawings, in which.

Figure 1:
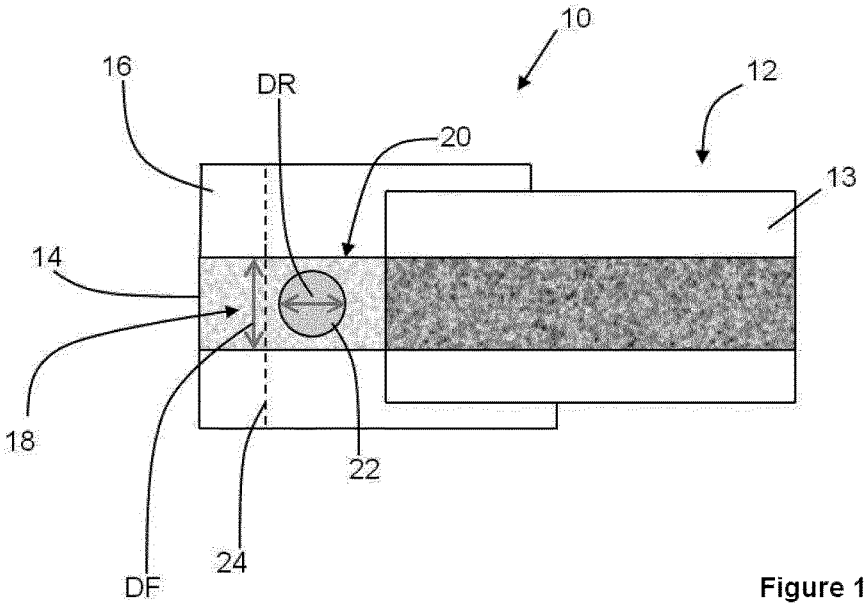
FIG. 1 illustrates a side sectional view of a smoking article in accordance with the present invention.

FIG. 1 shows a smoking article 10 in accordance with the present invention. The smoking article 10 comprises a rod 12 of tobacco cut filler circumscribed by a wrapper 13. The tobacco rod 12 is attached at one end to an axially aligned filter component 14. A band of tipping paper 16 circumscribes the filter 14 and a portion of the wrapped rod 12 of tobacco to join the filter component and the tobacco rod.

The filter component 14 comprises a filter segment 18 of filtration material circumscribed by a plug wrap 20 and having a diameter DF measured perpendicular to a longitudinal direction of the filter component 14. Further, the filter component 14 comprises a flow restrictor 22 embedded in the filter segment. In particular, the flow restrictor 22 is surrounded on all sides by the filtration material. A row of ventilation perforations 24 is provided through the tipping paper 16 at a location downstream of the flow restrictor 22.

In the embodiment of FIG. 1, the flow restrictor 22 is provided as a substantially spherical bead having a diameter DR. The diameter DR is about 80 percent of the diameter DF of the filter segment 18.

The flow restrictor comprises a composition that promotes degradation of the filtration material. In practice, the flow restrictor is used as a chamber to incorporate substances which will enhance cellulose acetate biodegradation according to one of the mechanisms described above.

EXAMPLES

Degradability of filters of smoking articles according to the invention was assessed in accordance with the CORESTA testing protocol for assessing the degradation of cigarette butts under natural conditions as described in Deutsch, Lance J—Cigarette Butt Degradability Task Force. Final Report—August, 2000—CORESTA—http://legacy.library.ucsf.edu/tid/qtg33a00.

In more detail, several substantially identical specimens of a cigarette butt were placed outdoors in two separate 6-compartment metal cages arranged on concrete and on soil, respectively. For the purposes of the protocol, a cigarette butt is defined as the filter with its plug wrap plus the tipping overwrap. 10 specimens were placed in each compartment, and each compartment was provided with a tag for identification of the specimen type. The specimens were exposed to the action of the weather for a period of 6 months. Weather conditions, i.e. sun radiation, wind, precipitation, humidity and temperature were monitored and recorded for the whole duration of the tests. The specimens were examined at the start of the test. Specimens were collected and examined at predetermined time intervals, after 1, 3 and 6 months of exposure to weather conditions. In particular, the weight and bulk volume of the samples were measured in order to assess cellulose degradation over time. Further, visual comparisons were carried out on the samples.

Comparative Example

As a reference, samples of butts from Marlboro Gold® cigarettes were tested for cellulose degradation. These filters contain a conventional segment of cellulose acetate and no agent capable of promoting cellulose degradation.

Example 1

A first set of cigarette butts in accordance with the present invention were prepared by including in a segment of cellulose acetate circumscribed by a paper wrapper and by tipping paper a restrictor bead comprising citric acid as the agent capable of promoting cellulose degradation. With the sole exception of the restrictor bead, the same materials found in butts of Marlboro Gold® cigarettes were used. Each mouthpiece contained a restrictor bead with a core containing 70 percent by weight citric acid and 30 percent by weight microcrystalline cellulose and coated with ethylcellulose. The ethylcellulose coating accounted for 15 percent of the overall weight of the bead. Thus, the overall composition of the bead was 59.5 percent citric acid, 25.5 percent microcrystalline cellulose and 15 percent by weight ethylcellulose. The overall weight of the restrictor was of about 45 mg. The overall weight of the cigarette butt excluding the restrictor was about 202 mg. Thus, the composition promoting degradation of the filtration material accounted for about 0.22 mg per mg of combined weight of the filtration segment. Specimens prepared in accordance with Example 1 were placed in two separate 6-compartment metal cages arranged on concrete and on soil, respectively. 10 specimens were placed in each compartment. The specimens were exposed to the action of the weather for a period of 6 months from January to June 2014 (tests were carried out in Ghent, Belgium).

Example 2

A second set of cigarette butts in accordance with the present invention were prepared by including in a segment of cellulose acetate circumscribed by a paper wrapper and by tipping paper a restrictor bead comprising sodium bisulphate as the agent capable of promoting cellulose degradation. With the sole exception of the restrictor bead, the same materials found in butts of Marlboro Gold® cigarettes were used. Each mouthpiece contained a restrictor bead with a core containing 80 percent by weight sodium bisulphate and 20 percent by weight microcrystalline cellulose and coated with ethylcellulose. The ethylcellulose coating accounted for 15 percent of the overall weight of the bead core. Thus, the overall composition of the bead was 68 percent by weight citric acid, 17 percent by weight microcrystalline cellulose and 15 percent by weight ethylcellulose. The overall weight of the restrictor was of about 26 mg. The overall weight of the cigarette butt excluding the restrictor was about 202 mg. Thus, the composition promoting degradation of the filtration material accounted for about 0.13 mg per mg of combined weight of the filter segment. Specimens prepared in accordance with Example 2 were placed in two separate 6-compartment metal cages arranged on concrete and on soil, respectively. 10 specimens were placed in each compartment. The specimens were exposed to the action of the weather for a period of 6 months from February to July 2014 (tests were carried out in Ghent, Belgium).

Weight Measurements

Figure 2:
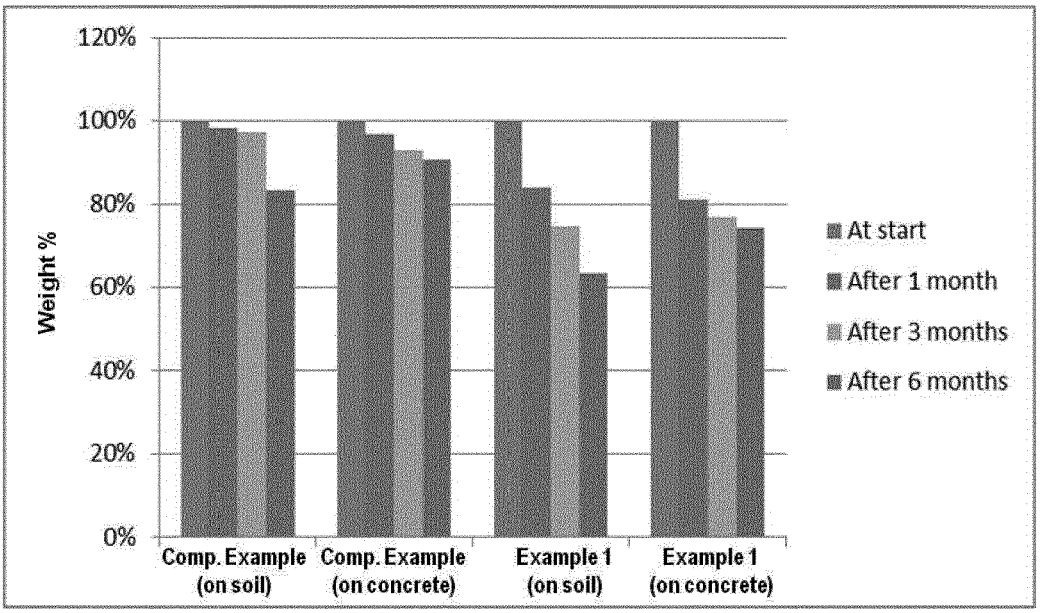
FIG. 2 illustrates a bar graph of change in weight over time for samples of a first embodiment (Example 1) of filters for smoking articles according to the present invention compared to filters according to the prior art.
Figure 4:
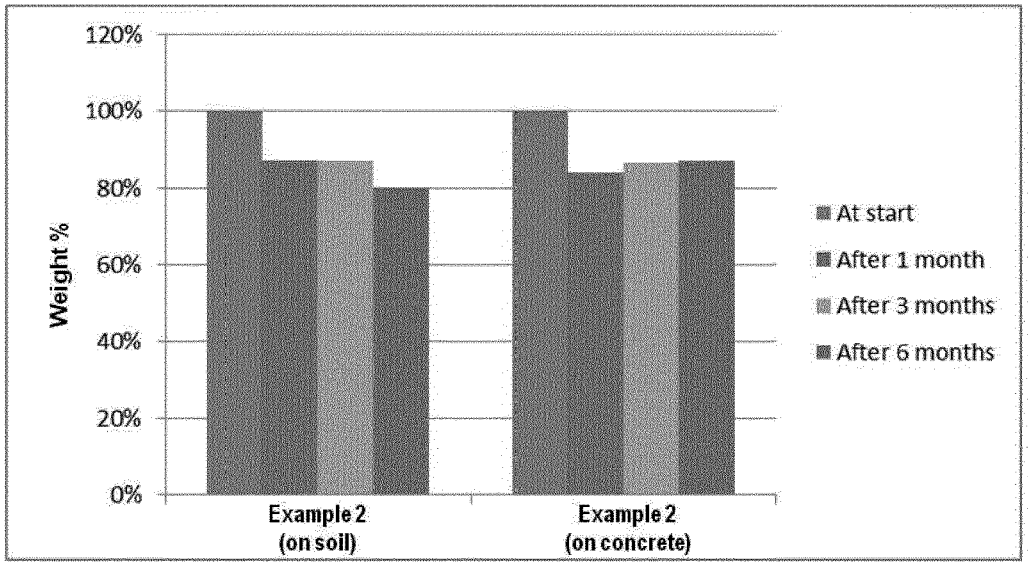
FIG. 4 illustrates a bar graph of change in weight over time for samples of a second embodiment (Example 2) of filters for smoking articles according to the present invention.

FIGS. 2 and 4 illustrate, by means of bar graphs, the change in weight over time measured for the cigarette butts of Examples 1 and 2 and the Comparative Example.

As can be seen from FIG. 2, the reduction in weight for the cigarette butts of Example 1 is always greater than the reduction in weight for the reference cigarette butts of the Comparative Example. In particular, after 6 months, a reduction in weight of about 40 percent was measured for the cigarette butts of Example 1 kept on soil, whereas a reduction in weight of less than 20 percent was measured for the cigarette butts of the Comparative Example kept on soil. As concerns samples kept on concrete, after 6 months a reduction in weight of more than 20 percent was measured for the cigarette butts of Example 1, whereas for the cigarette butts of the Comparative Example the reduction in weight was found to be slightly less than 10 percent. Thus, the experimental data would appear to suggest that, in general, the cellulose acetate degradation rate was approximately doubled for the cigarette butts of Example 1.

As regards the filters of Example 2, as can be inferred from FIG. 4, the reduction in weight is also consistently greater than the reduction in weight measured for the reference cigarette butts of the Comparative Example, although the effect is less evident than with the cigarette butts of Example 1.

Volume Measurements

Figure 3:
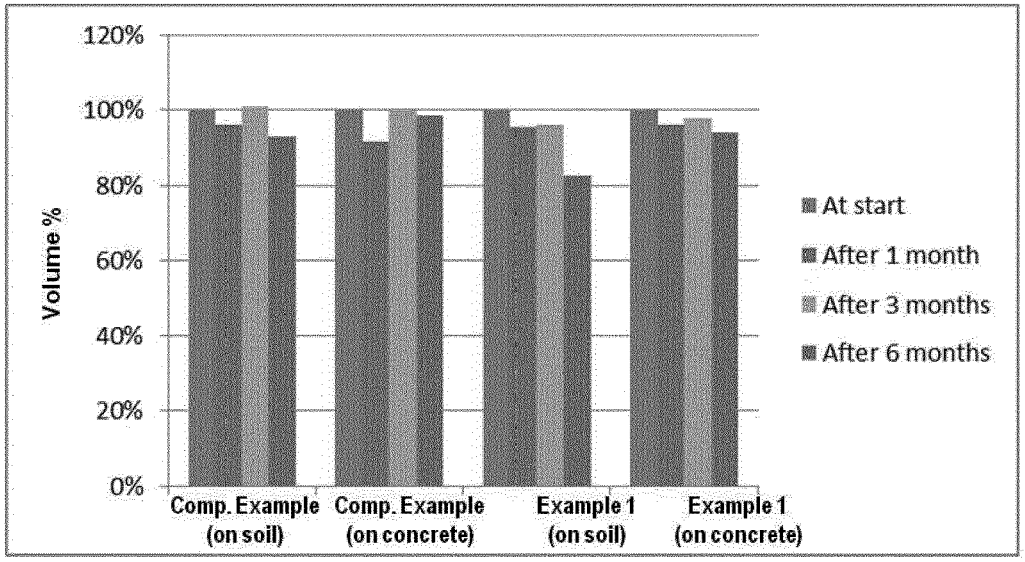
FIG. 3 illustrates a bar graph of change in volume over time for samples of a first embodiment (Example 1) of filters for smoking articles according to the present invention compared to filters according to the prior art.
Figure 5:
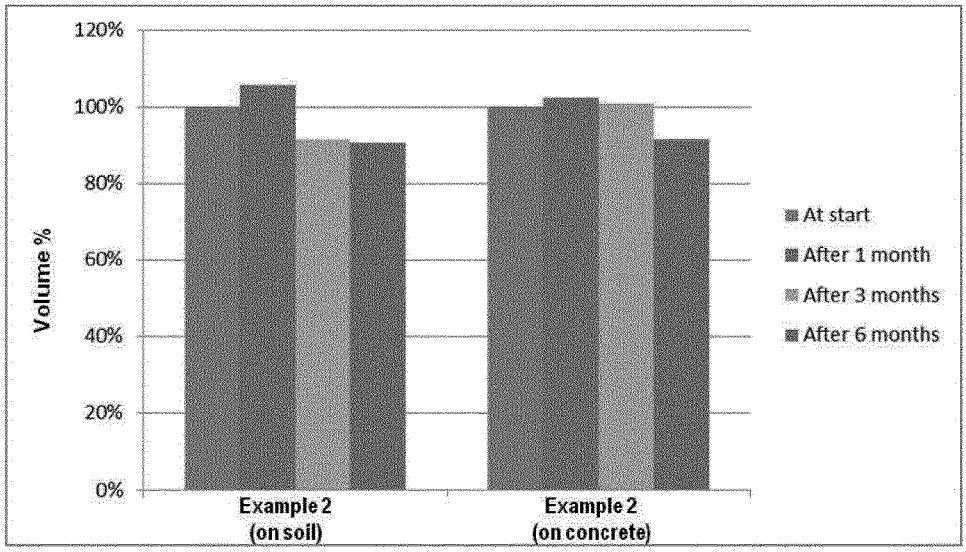
FIG. 5 illustrates a bar graph of change in volume over time for samples of a second embodiment (Example 2) of filters for smoking articles according to the present invention.

FIGS. 3 and 5 illustrate, by means of bar graphs, the change in weight over time measured for the cigarette butts of Examples 1 and 2 and the Comparative Example.

As can be seen from FIG. 3, the reduction in volume for the cigarette butts of Example 1 is always greater than the reduction in weight for the reference cigarette butts of the Comparative Example. In particular, after 6 months, a reduction in volume of about 20 percent was measured for the cigarette butts of Example 1 kept on soil, whereas a reduction in weight of about 8 percent was measured for the cigarette butts of the Comparative Example kept on soil. As concerns samples kept on concrete, after 6 months a reduction in weight of about 5 percent was measured for the cigarette butts of Example 1, whereas for the cigarette butts of the Comparative Example the reduction in volume was found to be just about 2 percent. Thus, the experimental data would appear to confirm that, in general, the cellulose acetate degradation rate was approximately doubled for the cigarette butts of Example 1.

As regards the cigarette butts of Example 2 (strong chemistry), as can be inferred from FIG. 5, the reduction in volume is also consistently greater than the reduction in volume measured for the reference cigarette butts of the Comparative Example although the effect is less evident than with the cigarette butts of Example 1.

The invention claimed is:

1. A smoking article comprising a tobacco rod and a filter component, the filter component comprising:

a filter segment of filtration material having a diameter measured perpendicular to a longitudinal direction of the filter; and a flow restrictor embedded in the filter segment;

wherein at least one cross sectional dimension of the flow restrictor, measured in a transverse direction of the filter segment, is at least about 50 percent of the diameter of the filter segment;

wherein the flow restrictor is made from an air-impermeable, non-compressible and water-soluble or water-dissolvable material; and wherein the flow restrictor comprises a composition that promotes degradation of the filtration material;

wherein the flow restrictor comprises a bead, the composition that promotes degradation of the filtration material at least partly coating the bead.

2. A smoking article according to claim 1, wherein the composition that promotes degradation of the filtration material comprises at least one of:

one or more nutrients suitable for sustaining microbial growth;

one or more compounds adapted to initiate or sustain enzymatic or acidic hydrolysis of the filtration material;

one or more acids;

one or more acid salts; and one or more bases.

3. A smoking article according to claim 2, wherein the one or more acid is selected from the group consisting of acetic, ascorbic, ascorbyl-2-phosphate, ascorbyl-2-sulfate, aspartic (aminosuccinic), cinnamic citric, folic, glutaric, lactic, malic (1-hydroxysuccinic), nicotinic (nician), oxalic, succinic, tartaric, boric, hydrochloric, nitric, phosphoric, sulphuric acid, and combinations thereof; or the one or more acid salt is selected from the group consisting of metal salts, where the metal is selected from aluminium, potassium, sodium or zinc, while the anion is selected from the group consisting of nitrates, dihydrogen phosphates, hydrogen phosphates, phosphates hydrogen sulphates, sulphates, and combinations thereof; or the one or more base is selected from the group consisting of metal hydroxides, calcium oxide (lime), urea, borax, sodium metasilicate, ammonium hydroxide, sodium carbonate, sodium phosphate tribasic, sodium hypochlorite, sodium hydrogen carbonate (sodium bicarbonate) and combinations thereof.

4. A smoking article according to claim 1, wherein the flow restrictor is surrounded on all sides by the filtration material.

5. A smoking article according to claim 1, wherein the flow restrictor is provided as a substantially spherical bead and the at least one cross sectional dimension of the bead measured in a transverse direction of the filter is the diameter of the substantially spherical bead.

6. A smoking article according to claim 1, wherein the flow restrictor is provided as a substantially cylindrical bead, the at least one cross sectional dimension of the bead measured perpendicular to a longitudinal direction of the filter being the diameter of the substantially cylindrical bead.

7. A smoking article according to claim 6, wherein the cylindrical bead has a length of less than about 90 percent of a length of the filter segment.

8. A smoking article according claim 1, wherein the flow restrictor has a compressive yield strength greater than about 8.0 kPa.

9. A smoking article according to claim 1, wherein the flow restrictor is at least about 6 millimeters from the downstream end of the filter.

10. A smoking article according to claim 1, comprising tipping material attaching the tobacco rod and the filter;

wherein the tipping material includes a ventilation zone comprising perforations through the tipping material.

11. A smoking article according to claim 10, wherein the ventilation zone comprises at least one circumferential row of perforations located at least about 1 millimeter downstream of the centre of the flow restrictor.

12. A smoking article according to claim 4, wherein the flow restrictor is provided as a substantially spherical bead and the at least one cross sectional dimension of the bead measured in a transverse direction of the filter is the diameter of the substantially spherical bead, and the diameter of the substantially spherical bead is at least about 70 percent and less than about 95 percent of the diameter of the filter segment.

13. A smoking article according to claim 10, wherein the flow restrictor is provided as a substantially spherical bead surrounded on all sides by the filtration material, and the ventilation zone comprises at least one circumferential row of perforations located at least about 1 millimeter downstream of the centre of the flow restrictor.

* * * * *